US010907856B2

(12) United States Patent
Momose et al.

(10) Patent No.: US 10,907,856 B2
(45) Date of Patent: Feb. 2, 2021

(54) HEAT EXCHANGER AND HEAT EXCHANGE VENTILATOR

(71) Applicant: MITSUBISHI ELECTRIC CORPORATION, Tokyo (JP)

(72) Inventors: Ippei Momose, Tokyo (JP); Masaru Takada, Tokyo (JP); Keishi Tsuda, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 261 days.

(21) Appl. No.: 16/077,596

(22) PCT Filed: Feb. 19, 2016

(86) PCT No.: PCT/JP2016/054952

§ 371 (c)(1),
(2) Date: Aug. 13, 2018

(87) PCT Pub. No.: WO2017/141444

PCT Pub. Date: Aug. 24, 2017

(65) Prior Publication Data

US 2019/0390869 A1 Dec. 26, 2019

(51) Int. Cl.
*F24F 12/00* (2006.01)
*F28D 9/00* (2006.01)
(Continued)

(52) U.S. Cl.
CPC ..... *F24F 12/006* (2013.01); *F28D 9/00* (2013.01); *F28D 21/0014* (2013.01); *F28F 3/08* (2013.01); *F28F 9/0075* (2013.01)

(58) Field of Classification Search
CPC ..... C09K 5/14; D21H 15/02; D21H 27/00; F24F 7/08; F24F 12/006; F28D 9/00;
(Continued)

(56) References Cited

U.S. PATENT DOCUMENTS 4,596,285 A * 6/1986 Dinulescu ..... F28F 3/083 165/166
5,322,117 A * 6/1994 Guetersloh ..... F28F 9/001 165/166
(Continued)

FOREIGN PATENT DOCUMENTS

CN 100504206 C 6/2009
JP S54-144770 U 10/1979
(Continued)

OTHER PUBLICATIONS

Taiwanese First Notice of Reasons for Refusual for Taiwanese Patent Application No. 105123390, dated Jun. 19, 2017.
(Continued)

*Primary Examiner* — Eric S Ruppert
*Assistant Examiner* — Hans R Weiland
(74) *Attorney, Agent, or Firm* — Buchanan Ingersoll & Rooney PC

(57) ABSTRACT

A heat exchanger includes a prism-shaped heat exchange element, a plurality of frame members mounted to sides of the element in a one-to-one relationship, the sides extending along an axial direction of the heat exchange element, and cover members each covering an end face of the element, the end face being perpendicular to the axial direction of the heat exchange element. The frame members are connected to each of the cover members. Gaps for allowing movement of each of the frame members along a direction perpendicular to the axial direction of the heat exchange element are provided at each connecting portion at which the frame members are connected to the cover member. Thus, it is possible to move the frame members along with deformation of the heat exchange element.

8 Claims, 11 Drawing Sheets

(51) Int. Cl.

| | |
|---|---|
| ***F28D 21/00*** | (2006.01) |
| ***F28F 9/007*** | (2006.01) |
| ***F28F 3/08*** | (2006.01) |

(58) Field of Classification Search
CPC ..... F28D 21/0014; F28F 3/08; F28F 9/007; F28F 9/0075; F28F 2265/14; F28F 2265/26; F28F 2280/06
See application file for complete search history.

(56) References Cited

U.S. PATENT DOCUMENTS

| | | | | |
|---|---|---|---|---|
| 5,383,516 | A * | 1/1995 | Dinulescu | F28D 9/0062 165/82 |
| 5,660,228 | A * | 8/1997 | Steege | F24F 12/006 165/145 |
| 8,955,578 | B2 | 2/2015 | Kwon et al. | |
| 9,816,725 | B2 | 11/2017 | Kwon et al. | |
| 2008/0017362 | A1* | 1/2008 | Kwon | F28D 9/0062 165/166 |
| 2011/0017436 | A1* | 1/2011 | Cho | F28F 9/001 165/166 |
| 2013/0062042 | A1* | 3/2013 | Dinulescu | F28F 9/001 165/166 |

FOREIGN PATENT DOCUMENTS

| | | | |
|---|---|---|---|
| JP | 06-313694 | A | 11/1994 |
| JP | H07-049187 | A | 2/1995 |
| JP | 2008-025982 | A | 2/2008 |
| JP | 2010-248680 | A | 11/2010 |
| WO | 2017/141445 | A1 | 8/2017 |

OTHER PUBLICATIONS

Taiwanese Second Notice of Reasons for Refusual for Taiwanese Patent Application No. 105123390, dated Dec. 19, 2017.
International Search Report (PCT/ISA/210) dated Apr. 19, 2016, by the Japanese Patent Office as the International Searching Authority for International Application No. PCT/JP2016/054952.
Written Opinion (PCT/ISA/237) dated Apr. 19, 2016, by the Japanese Patent Office as the International Searching Authority for International Application No. PCT/JP2016/054952.
Office Action (Notification of Reasons for Refusal) dated Sep. 25, 2018, by the Japan Patent Office in corresponding Japanese Patent Application No. 2017-567931 and English translation of the Office Action. (5 pages).
Extended European Search Report dated Nov. 19, 2018, issued by the European Patent Office in corresponding European Application No. 16890585.9. (7 pages).
Office Action dated Jun. 12, 2019, by the Chinese Patent Office in corresponding Chinese Patent Application No. 201680081513.7 and English translation of the Office Action. (10 pages).

* cited by examiner

HEAT EXCHANGER AND HEAT EXCHANGE VENTILATOR

FIELD

The present invention relates to a heat exchanger to perform heat exchange between a supply air flow and an exhaust air flow, and a heat exchange ventilator to perform ventilation while allowing the heat exchanger to perform the heat exchange.

BACKGROUND

Conventionally, a heat exchange ventilator including a heat exchanger to perform heat exchange between a supply air flow and an exhaust air flow has been known as a ventilator to perform ventilation in a building. For example, Patent Literature 1 discloses a heat exchange ventilator. For the disclosed ventilator, a corner guide (frame member) is adhered to each corner portion of a heat exchange element of the heat exchanger and fixed to covers each covering an end face of the heat exchange element, thereby protecting the corner portions of the heat exchange element and ensuring airtightness at abutting portions between a heat exchange ventilator body and the heat exchange element.

CITATION LIST

Patent Literature

Patent Literature 1: Japanese Patent Application Laid-open No. 2008-25982

SUMMARY

Technical Problem

Unfortunately, a heat exchange element generally formed of specially processed paper tends to contract due to long-term use because the heat exchange element repeats drying and wetting due to air passing through the heat exchange element. For the configuration of Patent Literature 1, the frame member adhered to each corner portion of the heat exchange element is fixed to the covers. Thus, the contraction of the heat exchange element deforms the frame member, unsticks the heat exchange element and the frame member from each other, or deforms or damages the heat exchange element. As a result, a gap is formed between the heat exchange element and each frame member, and inside the heat exchange element. Airflow leaks from one of the supply air flow path and the exhaust air flow path to the other through the gap. Such an airflow leakage poses problems such as the change in an amount of ventilation of air, the mixing of contaminant elements contained in the exhaust air flow, into the supply air flow, and the reduction in the heat exchange efficiency.

The present invention has been made in view of the above, and it is an object of the present invention to provide a heat exchanger and a heat exchange ventilator capable of suppressing occurrence of leakage of airflow between a supply air flow and an exhaust air flow even if a heat exchange element contracts due to the long-term use.

Solution to Problem

To solve the above problem and achieve the object, the present invention provides a heat exchanger to perform heat exchange between a supply air flow and an exhaust air flow, comprising: a prism-shaped heat exchange element; and a plurality of frame members mounted to sides of the heat exchange element in a one-to-one relationship, the sides extending along an axial direction of the heat exchange element. The frame members are movable along with deformation of the heat exchange element.

Advantageous Effects of Invention

The heat exchanger and the heat exchange ventilator of the present invention have an effect of suppressing the occurrence of the leakage of airflow between the supply air flow and the exhaust air flow even if the heat exchange element contracts due to the long-term use.

DESCRIPTION OF EMBODIMENTS

Hereinafter, a heat exchanger and a heat exchange ventilator according to each embodiment of the present invention will be described in detail with reference to the drawings. The invention is not limited to the embodiments.

First Embodiment

Figure 1:
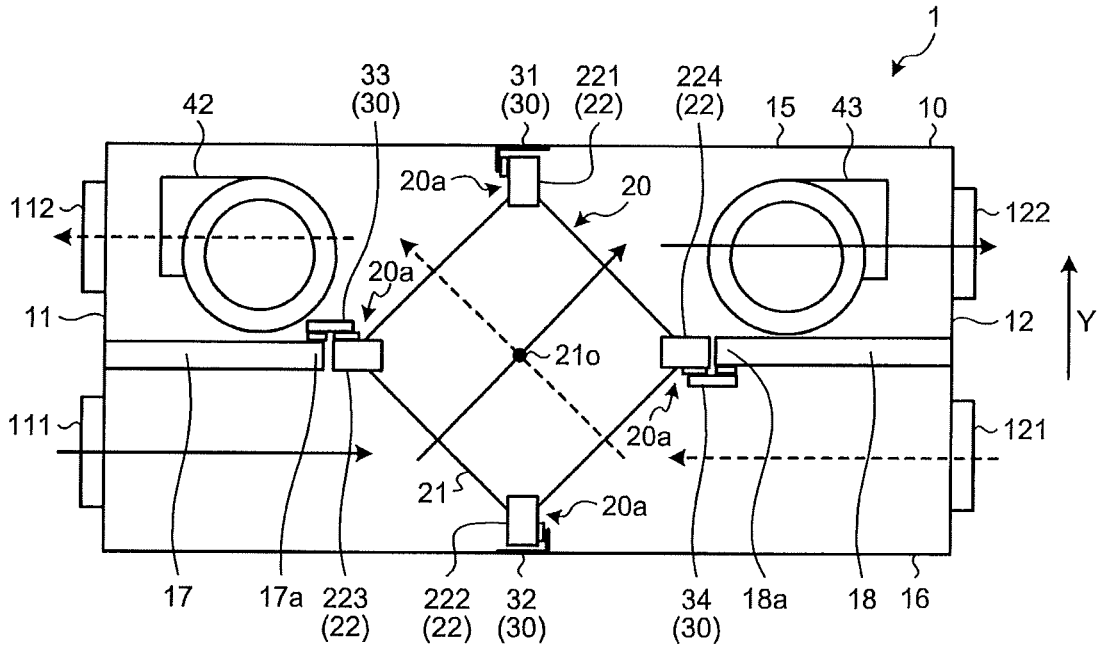
FIG. 1 is a schematic front view illustrating a heat exchange ventilator according to a first embodiment.
Figure 2:
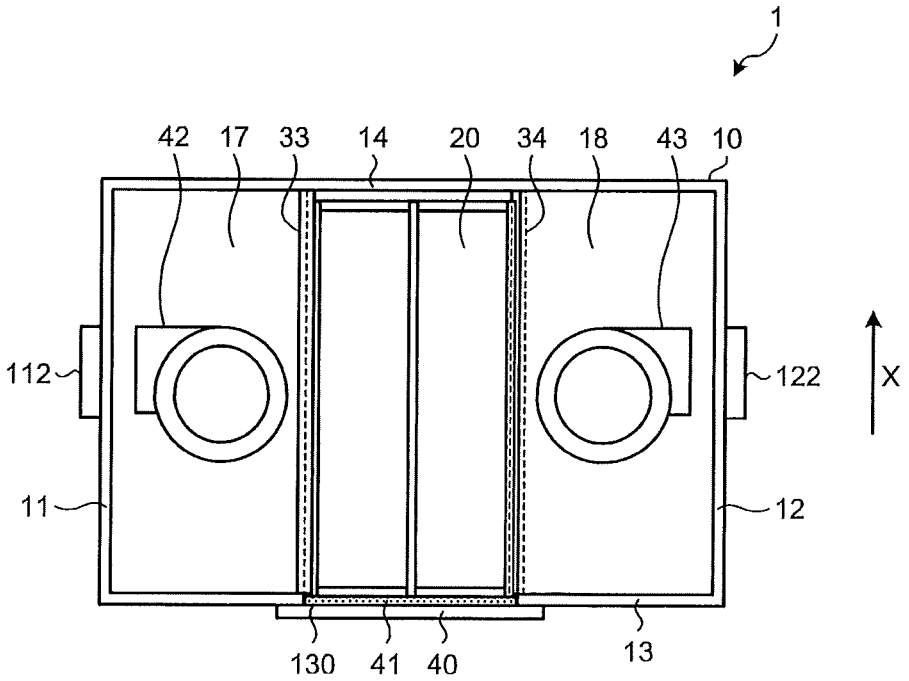
FIG. 2 is a schematic plan view illustrating the heat exchange ventilator according to the first embodiment.

FIG. 1 is a schematic front view illustrating a heat exchange ventilator 1 according to a first embodiment, and FIG. 2 is a schematic plan view illustrating the heat exchange ventilator 1 according to the first embodiment. The heat exchange ventilator 1 is a total-heat-exchanger-type ventilator mounted in an attic for supplying and discharging air through a duct (not illustrated). The heat exchange ventilator 1 includes a housing 10, a heat exchanger 20, and a plurality of support members 30. The housing 10 defines an outer contour of the ventilator. The heat exchanger 20 is in a prism shape (quadrangular prism shape in the first embodiment), and accommodated in the housing 10 such that the heat exchanger 20 can be inserted into and removed from the housing 10. The support members 30 support the heat exchanger 20 in the housing 10.

The housing 10 is formed as a hexahedron which includes a first side plate 11, a second side plate 12, a third side plate 13, a fourth side plate 14, a top plate 15, and a bottom plate 16. The first side plate 11 is disposed on an outdoor side. The second side plate 12 is opposite to the first side plate 11 and is disposed on an indoor side. The third side plate 13 extends between the first side plate 11 and the second side plate 12. The fourth side plate 14 is opposite to the third side plate 13 and extends between the first side plate 11 and the second side plate 12. The top plate 15 is mounted to upper portions of the first side plate 11, the second side plate 12, the third side plate 13, and the fourth side plate 14. The bottom plate 16 is mounted to lower portions of the first side plate 11, the second side plate 12, the third side plate 13, and the fourth side plate 14. When the heat exchange ventilator 1 is installed, the housing 10 is disposed such that the top plate 15 is positioned on an upper side in a vertical direction Y and the bottom plate 16 is positioned on a lower side in the vertical direction Y.

The first side plate 11 includes an outdoor-side inlet 111, which draws outdoor air, and an outdoor-side exhaust port 112, which discharges indoor air to the outdoors. The second side plate 12 includes an indoor-side inlet 121, which draws indoor air, and an indoor-side outlet 122, which supplies the indoor space with outdoor air drawn from the outdoor-side inlet 111. As illustrated in FIG. 2, the third side plate 13 includes a maintenance opening 130, which allows the heat exchanger 20 to be inserted into and removed from the housing 10. Moreover, a maintenance cover 40, which closes the maintenance opening 130, is detachably mounted to the third side plate 13. A seal member 41 adhered to the inside of the maintenance cover 40 abuts on an end face of the heat exchanger 20 and an inner peripheral surface of the maintenance opening 130.

The housing 10 includes a first casing 17 and a second casing 18, which define a supply air flow path and an exhaust air flow path as flow paths independent of each other. The outdoor-side inlet 111 and indoor-side outlet 122 communicate with each other by the supply air flow path, and the supply air flow path directs a supply air flow in a direction of solid arrows illustrated in FIG. 1. The indoor-side inlet 121 and the outdoor-side exhaust port 112 communicate with each other by the exhaust air flow path, and the exhaust air flow path directs an exhaust air flow in a direction of broken arrows illustrated in FIG. 1. The first casing 17 holds an exhaust air blower 42, which is disposed in the middle of the exhaust air flow path for generating an exhaust air flow. The second casing 18 holds a supply air blower 43, which is disposed in the middle of the supply air flow path for generating a supply air flow.

As illustrated in FIG. 1, the heat exchanger 20 is disposed in a central portion of the housing 10 in the middle of the supply air flow path and the middle of the exhaust air flow path, and forms a part of the supply air flow path and the exhaust air flow path. As illustrated in FIG. 1, corner portions 20*a* at four corners of the heat exchanger 20 are supported by the support members 30 fixed to the housing 10.

Figure 3:
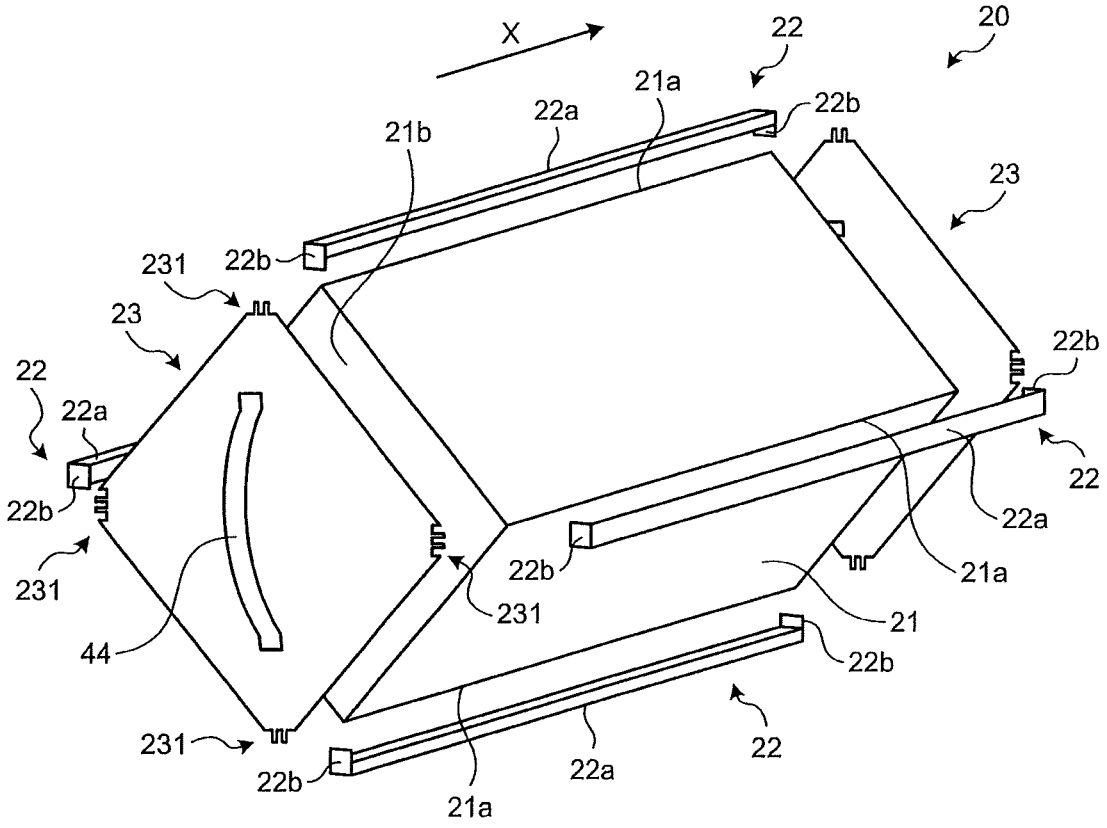
FIG. 3 is an exploded perspective view illustrating a heat exchanger according to the first embodiment.
Figure 4:
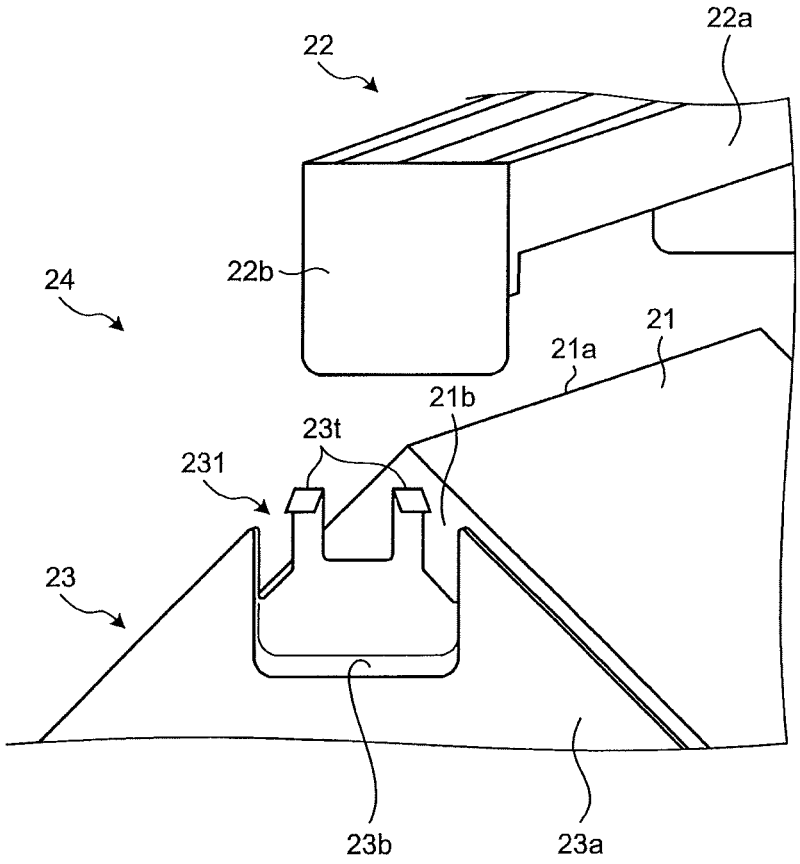
FIG. 4 is an enlarged view of relevant parts of the heat exchanger according to the first embodiment.

A configuration of the heat exchanger 20 according to the first embodiment will be described. FIG. 3 is an exploded perspective view of the heat exchanger 20, and FIG. 4 is an enlarged view of relevant parts of the heat exchanger 20. The heat exchanger 20 includes a prism-shaped heat exchange element 21, four frame members 22, and two cover members 23. The four frame members 22 are mounted in a one-to-one relationship, to sides 21*a* extending along an axial direction X of the heat exchange element 21. The two cover members 23 cover end faces 21*b* perpendicular to the axial direction X of the heat exchange element 21, and the frame members 22 are connected to the two cover members 23. In the first embodiment, there are four frame members 22, but the number of frame members 22 is not limited to four.

The heat exchange element 21 is formed of specially processed paper and is in a prismatic shaped having a square cross-section taken along a plane perpendicular to the axial direction X. The heat exchange element 21 may have a rectangular cross-section taken along a plane perpendicular to the axial direction X, or a polygonal cross-section taken along a plane perpendicular to the axial direction X. That is, the heat exchanger 20 may be in a polygonal prism shape. Although a detailed configuration of the heat exchange element 21 is not illustrated, the heat exchange element 21 includes a plurality of supply air passages through which supply air passes and a plurality of exhaust air passages through which exhaust air passes. Each supply air passage and each exhaust air passage intersect, and act as the flow paths independent of each other.

As illustrated in FIGS. 3 and 4, each frame member 22 includes a frame body 22*a* extending along the axial direction X of the heat exchange element 21, and protrusions 22*b* extending in a direction perpendicular to the axial direction X of the heat exchange element 21 at both ends of the frame body 22*a*. The frame body 22*a* is formed to be capable of abutting on the side 21*a* of the heat exchange element 21. The frame body 22*a* has a portion to abut on the side 21*a*, and an adhesive or a sealant is applied to this portion of the frame body 22*a*. Consequently, each frame member 22 is fixed to each side 21*a* of the heat exchange element 21 by adhesion.

As illustrated in FIG. 4, each cover member 23 includes a cover body 23*a* and a plurality of recesses 23*b*. The cover body 23*a* is in a rectangular shape along the end face 21*b* of the heat exchange element 21 and abuts on the end face 21*b*. The recesses 23*b* are formed in corner portions 231 at four corners of a surface of the cover body 23*a*, the surface being opposite to the surface abutting on the end face 21*b* of the heat exchange element 21. The recessed 23*b* are recessed toward the end face 21*b* of the heat exchange element 21. A handle 44 used at a time of maintenance operation is mounted to the surface of the cover body 23*a*, the surface being opposite to the heat exchange element 21.

Figure 5:
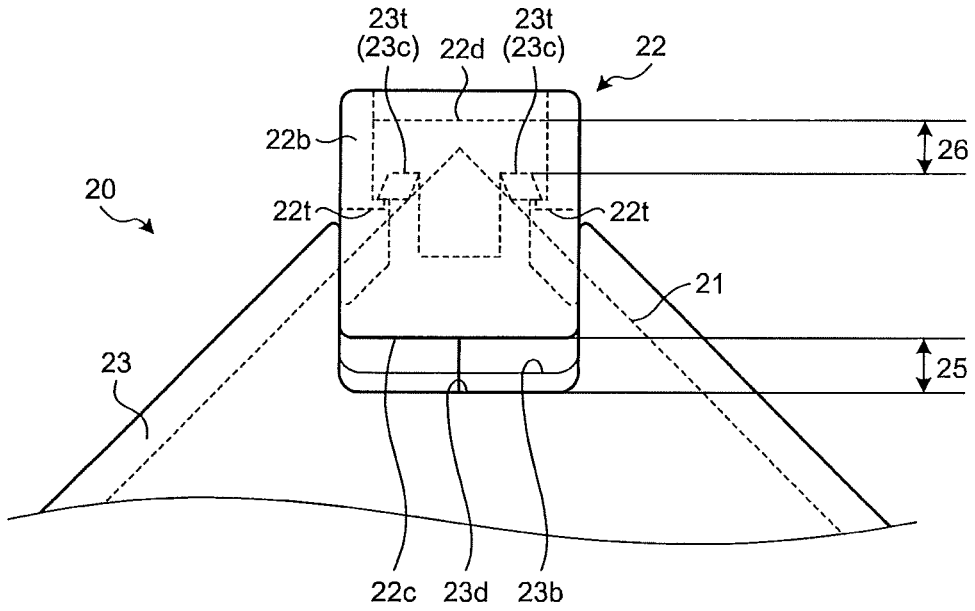
FIG. 5 is an explanatory view illustrating a connecting portion between a frame member and a cover member of the heat exchanger according to the first embodiment.
Figure 6:
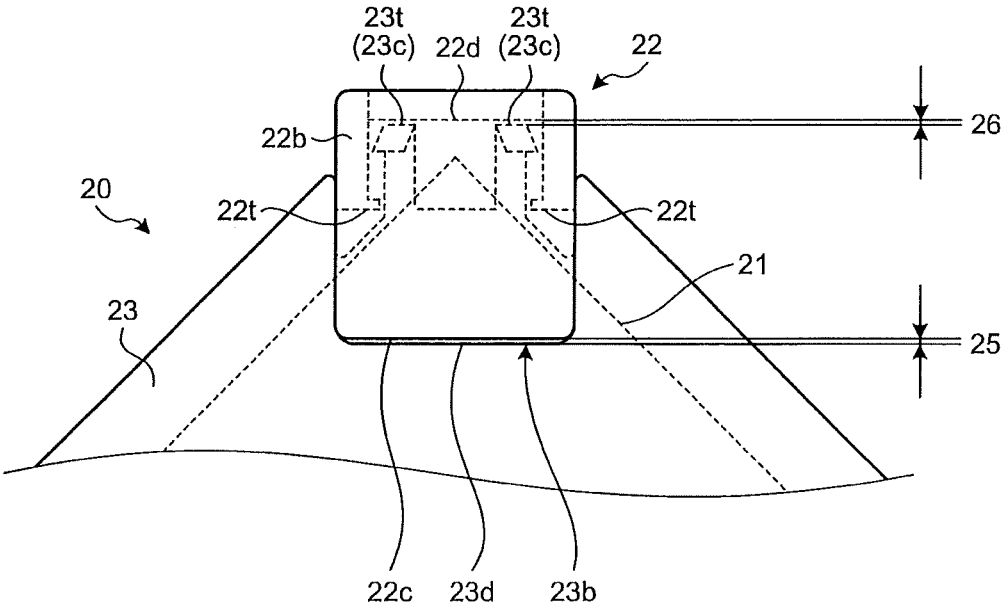
FIG. 6 is an explanatory view illustrating the connecting portion between the frame member and the cover member of the heat exchanger according to the first embodiment.

Each of the frame members 22 is connected to the cover members 23 at a connecting portion 24. The connecting portion 24 includes the protrusion 22*b* of the frame member 22 and the recess 23*b* of the cover member 23. FIGS. 5 and 6 are explanatory views each illustrating the connecting portion 24 at which the frame member 22 are connected to the cover member 23 of the heat exchanger 20. As illustrated in FIG. 5, the protrusion 22*b* of the frame member 22 fits in the recess 23*b* of the cover member 23 such that the protrusion 22*b* can slide in the direction perpendicular to the axial direction X of the heat exchange element 21, and covers the recess 23*b* from a side opposite to the heat exchange element 21.

As illustrated in FIG. 5, the protrusion 22*b* of the frame member 22 includes frame-side hooking portions 22*t* protruding inwardly from the both side portions between a distal end 22*c* of the protrusion 22*b* (hereinafter referred to as a protrusion distal end 22*c*) and a proximal end 22*d* of the protrusion 22*b* (hereinafter referred to as a protrusion proximal end 22*d*). The recess 23*b* of the cover member 23 includes two cover-side hooking portions 23*t* each having a hook shape that can be hooked on the frame-side hooking portion 22*t*. The frame-side hooking portions 22*t* are connectable to the cover-side hooking portions 23*t* by snap fitting. It is thus possible to prevent the protrusion 22*b* and the recess 23*b* from coming off easily, and hence suppress disengagement of each frame member 22 from the cover members 23 in mounting one end of the frame member 22 and subsequently mounting the other end thereof during the assemblage. This achieves the easy connecting operation. The abutment of the cover members 23 on the end faces 21*b* of the heat exchange element 21 and the connection of each frame member 22 adhered to the side 21*a* of the heat exchange element 21 to the cover members 23, as described above, can stably keep the shape of the heat exchange element 21 formed of the specially processed paper.

As illustrated in FIG. 5, gaps 25 and 26 are provided in the connecting portion 24 at which the frame member 22 and the cover member 23 are connected to each other. The gaps 25 and 26 allow the frame member 22 to move along the direction perpendicular to the axial direction X of the heat exchange element 21. The gap 25 is provided between the protrusion distal end 22*c* of the protrusion 22*b* of the frame member 22 and a recess proximal end 23*d* of the recess 23*b* of the cover member 23. The gap 26 is provided between the protrusion proximal end 22*d* of the protrusion 22*b* of the frame member 22 and a recess distal end 23*c* of the recess 23*b* of the cover member 23. In the first embodiment, the recess distal end 23*c* is a distal end of the cover-side hooking portion 23*t*.

Figure 7:
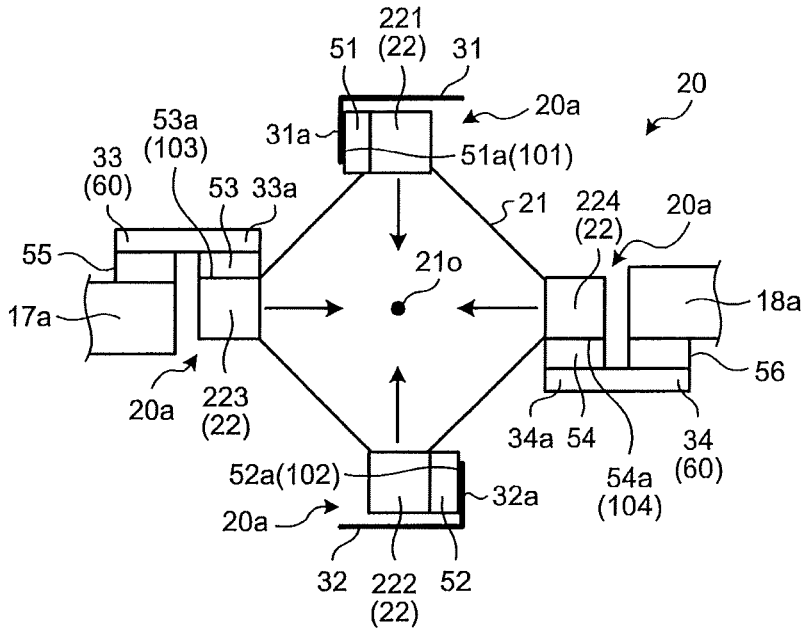
FIG. 7 is a schematic view illustrating a direction in which the heat exchange element of the heat exchanger according to the first embodiment contracts.

When the heat exchange ventilator 1 is used for a long period of time, the heat exchange element 21 may swell and contract through repetitious drying and wetting due to air passing through the heat exchange ventilator 1. FIG. 7 is a schematic view illustrating a direction in which the heat exchange element 21 contracts. The heat exchange element 21 contracts toward an axial center 21*o*. In the heat exchanger 20 of the first embodiment, as described above, the gaps 25 and 26, which allow each frame member 22 to move along the direction perpendicular to the axial direction X of the heat exchange element 21 are provided in each of the connecting portions 24 at which the frame members 22 are connected to the cover members 23. This structure enables each frame member 22 to move in a direction toward the axial center 21*o* of the heat exchange element 21 by a distance corresponding to the gaps 25 and 26, as illustrated in FIG. 6, even if the heat exchange element 21 contracts toward the axial center 21*o*.

For the heat exchange ventilator 1, as described above, when the heat exchange element 21 contracts toward the axial center 21*o* due to the long-term use, the frame members 22 move along with the deformation of the heat exchange element 21, thereby satisfactorily suppressing deformation of the frame members 22, unsticking of the frame members 22 from the heat exchange element 21, and deformation of or damage to the heat exchange element 21. Accordingly, the heat exchange ventilator 1 prevents a gap from being formed between the heat exchange element 21 and each frame member 22 and from being formed inside the heat exchange element 21, and thus satisfactorily suppresses change in the amount of ventilation of air due to leakage of airflow from one of the supply air flow path and the exhaust air flow path to the other, mixing of contaminant elements contained in the exhaust airflow, into the supply air flow, and reduction in the heat exchange efficiency.

In the first embodiment, preferably, all the gaps 25 and 26 are of equal length and the length is half the maximum length by which the heat exchange element 21 contracts due to the long-term use. Since all the gaps 25 and 26 have the equal length, it becomes possible to suppress uneven amounts of movements of the frame members 22 positioned on the diagonal line, thus satisfactorily suppressing displacement of the axial center 21*o* of the heat exchange element 21 from the original position at the time the heat exchange element 21 is initially mounted.

Since the length of the gaps 25 and 26 is the half maximum contraction length of the heat exchange element 21, the frame members 22 move along with the deformation of the heat exchange element 21 by at least the distance corresponding to the gaps 25 and 26, thereby satisfactorily suppressing the deformation of the frame members 22, the unsticking of the frame members 22 from the heat exchange element 21, and the deformation of or damage to the heat exchange element 21.

Next, a supporting structure of the heat exchanger 20 in the housing 10 will be described. In the following description, the frame member 22 mounted to the side 21*a* of the heat exchange element 21 on a side of the top plate 15 (upper side in FIG. 1) is referred to as a first frame member 221. The frame member 22 mounted to the side 21*a* of the heat exchange element 21 on a side of the bottom plate 16 (lower side in FIG. 1) is referred to as a second frame member 222. The frame member 22 mounted to the side 21*a* of the heat exchange element 21 on a side of the first side plate 11 (left side in FIG. 1) is referred to as a third frame member 223. The frame member 22 mounted to the side 21*a* of the heat exchange element 21 on a side of the second side plate 12 (right side in FIG. 1) is referred to as a fourth frame member 224.

Figure 8:
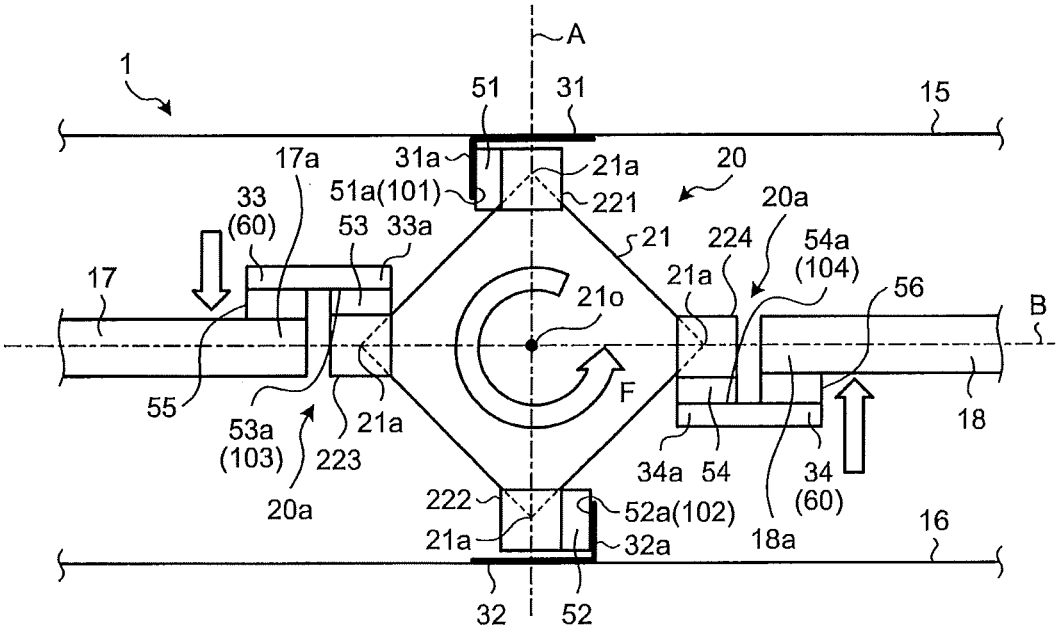
FIG. 8 is a schematic view illustrating a state where the heat exchanger is mounted in a housing.
Figure 9:
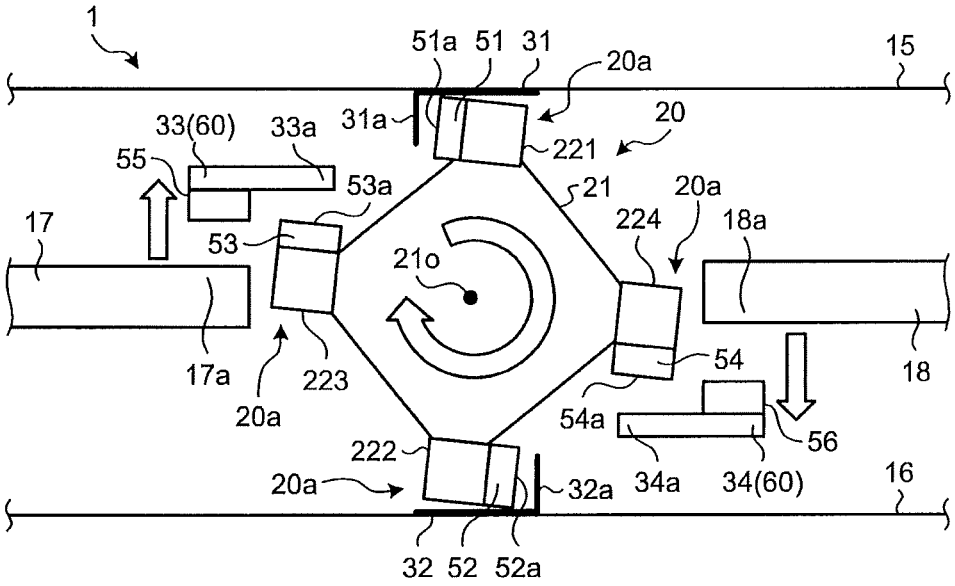
FIG. 9 is a schematic view illustrating a state where the heat exchanger is inserted into and removed from the housing.

FIG. 8 is a schematic view illustrating a state where the heat exchanger 20 is mounted in the housing 10 and FIG. 9 is a schematic view illustrating a state where the heat exchanger 20 is inserted into and removed from the housing 10. As illustrated in FIGS. 8 and 9, in the housing 10, the heat exchanger 20 is rotatable in one direction indicated by a circular arrow of FIG. 8, and in the other direction indicated by a circular arrow of FIG. 9.

As illustrated in FIG. 8, a seal member 51 is adhered to the first frame member 221 of the heat exchanger 20 along the frame body 22*a*. An end face 51*a* of the seal member 51 on a side of the first side plate 11 extends in parallel to a plane A passing through the side 21*a* of the heat exchange element 21 on the side of the top plate 15, the side 21*a* thereof on the side of the bottom plate 16, and the axial center 21*o* of the heat exchange element 21 when the heat exchanger 20 is mounted. A seal member 52 is adhered to the second frame member 222 of the heat exchanger 20 along the frame body 22*a*. An end face 52*a* of the seal member 52 on a side of the second side plate 12 extends in parallel to the plane A.

A seal member 53 is adhered to the third frame member 223 of the heat exchanger 20 along the frame body 22*a*. An end face 53*a* of the seal member 53 on a side of the top plate 15 extends in parallel to a plane B passing through the side

21*a* of the heat exchange element 21 on the side of the first side plate 11, the side 21*a* thereof on the side of the second side plate 12, and the axial center 21*o* of the heat exchange element 21 when the heat exchanger 20 is mounted. A seal member 54 is adhered to the fourth frame member 224 of the heat exchanger 20 along the frame body 22*a*. An end face 54*a* of the seal member 54 on a side of the bottom plate 16 extends in parallel to the plane B.

As described above, the heat exchanger 20 is supported by the support members 30. As illustrated in FIG. 8, the support members 30 are arranged surrounding the heat exchanger 20. The support members 30 include a first fixed rail 31 and a second fixed rail 32, which are fixed to the housing 10. The support members 30 also include a first movable rail 33 and a second movable rail 34, which are supported by the housing 10 to move in the direction perpendicular to the axial direction X of the heat exchange element 21. The first movable rail 33 and the second movable rail 34 also function as rotation force imparting means 60, which imparts to the heat exchanger 20 a rotation force F in one direction indicated by the circular arrow of FIG. 8.

The first fixed rail 31 is a rail extending in the axial direction X of the heat exchange element 21. The first fixed rail 31 is fixed to the top plate 15 at the central portion of the housing 10. The first fixed rail 31 includes a first abutting portion 31*a*, which extends along the axial direction X of the heat exchange element 21. The first abutting portion 31*a* is formed on the side of the first frame member 221 in one direction. That is, the first abutting portion 31*a* is formed on the side toward which the first frame member 221 faces in the direction indicated by the circular arrow of FIG. 8. The first abutting portion 31*a* extends in parallel to the plane A and is formed to be capable of abutting on the end face 51*a* of the seal member 51 adhered to the first frame member 221. That is, an abutting surface 101 between the end face 51*a* of the seal member 51 adhered to the first frame member 221 and the first abutting portion 31*a* of the first fixed rail 31 extends in parallel to the plane A.

The second fixed rail 32 is a rail extending in the axial direction X of the heat exchange element 21 and is fixed to the bottom plate 16 at the central portion of the housing 10. The second fixed rail 32 includes a first abutting portion 32*a*, which extends along the axial direction X of the heat exchange element 21. The first abutting portion 32*a* is formed on the side of the second frame member 222 in the one direction. That is, the first abutting portion 32*a* is formed on the side toward which the second frame member 222 faces in the direction indicated by the circular arrow of FIG. 8. The first abutting portion 32*a* extends in parallel to the plane A and is formed to be capable of abutting on the end face 52*a* of the seal member 52 adhered to the second frame member 222. That is, an abutting surface 102 between the end face 52*a* of the seal member 52 adhered to the second frame member 222 and the first abutting portion 32*a* of the second fixed rail 32 extends in parallel to the plane A.

As illustrated in FIG. 2, the first movable rail 33 and the second movable rail 34 are rails extending in the axial direction X of the heat exchange element 21. The first movable rail 33 and the second movable rail 34 are supported by the third side plate 13 and the fourth side plate 14 of the housing 10 to move in the direction perpendicular to the axial direction X of the heat exchange element 21 and the vertical direction Y. As illustrated in FIG. 8, one of the first movable rail 33 and the second movable rail 34 is provided on one side of the plane A while the other movable rail is provided on the opposite side of the plane A. In the first embodiment, the first movable rail 33 includes a filter support 33*b* (see FIG. 10), which supports a filter 45 disposed along a lower edge portion of the heat exchanger 20. In the first embodiment, the second movable rail 34 includes a filter support 34*b* (see FIG. 10), which supports a filter 46 disposed along the lower edge portion of the heat exchanger 20.

The first movable rail 33 is disposed above the third frame member 223 and an end portion 17*a* of the first casing 17 separating the supply air flow path and the exhaust air flow path from each other, the end portion 17*a* being located on a side of the heat exchanger 20. That is, the first movable rail 33 is disposed on the side of the end portion 17*a* and third frame member 223 facing the top plate 15. A seal member 55 is adhered to a surface of the first movable rail 33, the surface facing the end portion 17*a* of the first casing 17. The first movable rail 33 is capable of abutting on the end portion 17*a* of the first casing 17 via the seal member 55. The first movable rail 33 includes a second abutting portion 33*a*, which extends along the axial direction X of the heat exchange element 21. The second abutting portion 33*a* is formed on the side of the third frame member 223 in the opposite direction. That is, the second abutting portion 33*a* is formed on the side toward which the third frame member 223 faces in the direction indicated by the circular arrow of FIG. 9. The second abutting portion 33*a* extends in parallel to the plane B and is formed to be capable of abutting on the end face 53*a* of the seal member 53 adhered to the third frame member 223. That is, an abutting surface 103 between the end face 53*a* of the seal member 53 adhered to the third frame member 223 and the second abutting portion 33*a* of the first movable rail 33 extends in parallel to the plane B.

The second movable rail 34 is disposed below the fourth frame member 224 and an end portion 18*a* of the second casing 18 separating the supply air flow path and the exhaust air flow path from each other, the end portion 18*a* being located on a side of the heat exchanger 20. That is, the second movable rail 34 is disposed on the side of the end portion 18*a* and fourth frame member 224 facing the bottom plate 16. A seal member 56 is adhered to a surface of the second movable rail 34, the surface facing the end portion 18*a* of the second casing 18. The second movable rail 34 is capable of abutting on the end portion 18*a* of the second casing 18 via the seal member 56. The second movable rail 34 includes a second abutting portion 34*a*, which extends along the axial direction X of the heat exchange element 21. The second abutting portion 34*a* is formed on the side of the fourth frame member 224 in the opposite direction. That is, the second abutting portion 34*a* is formed on the side toward which the fourth frame member 224 faces in the direction indicated by the circular arrow of FIG. 9. The second abutting portion 34*a* extends in parallel to the plane B and is formed to be capable of abutting on the end face 54*a* of the seal member 54 adhered to the fourth frame member 224. That is, an abutting surface 104 between the end face 54*a* of the seal member 54 adhered to the fourth frame member 224 and the second abutting portion 34*a* of the second movable rail 34 extends in parallel to the plane B.

To mount the heat exchanger 20 to the housing 10 in the heat exchange ventilator 1 configured as described above, first, as illustrated in FIG. 9, the first movable rail 33 is moved upward, that is, toward the top plate 15, such that the first movable rail 33 is disposed away from the end portion 17*a* of the first casing 17. Meanwhile, the second movable rail 34 is moved downward, that is, toward the bottom plate 16, such that the second movable rail 34 is disposed away from the end portion 18*a* of the second casing 18. Consequently, as illustrated in FIG. 9, the seal member 51 adhered to the first frame member 221 of the heat exchanger 20 is spaced away from the first abutting portion 31*a* of the first fixed rail 31. The seal member 52 adhered to the second frame member 222 is spaced away from the first abutting portion 32*a* of the second fixed rail 32. The seal member 53 adhered to the third frame member 223 is spaced away from the second abutting portion 33*a* of the first movable rail 33. The seal member 54 adhered to the fourth frame member 224 is spaced away from the second abutting portion 34*a* of the second movable rail 34. With the seal members 51, 52, 53, and 54 spaced from the first abutting portion 31*a*, the first abutting portion 32*a*, the second abutting portion 33*a*, and the second abutting portion 34*a*, respectively, the heat exchanger 20 can be easily slid and inserted into the housing 10 from the maintenance opening 130 formed in the third side plate 13. The seal members 51, 52, 53, and 54 can be satisfactorily protected because the seal members 51, 52, 53, 54 can avoid contacts with the first fixed rail 31, the second fixed rail 32, the first movable rail 33, and the second movable rail 34 when the heat exchanger 20 is inserted into the housing 10.

Thereafter, as illustrated in FIG. 8, the first movable rail 33 is moved downward, that is, toward the bottom plate 16 and fixed, such that the seal member 55 of the first movable rail 33 is pressed against the end portion 17*a* of the first casing 17 while the second abutting portion 33*a* of the first movable rail 33 is pressed against the end face 53*a* of the seal member 53 adhered to the third frame member 223. As a result, the second abutting portion 33*a* of the first movable rail 33 presses the third frame member 223 downward via the end face 53*a* of the seal member 53. Furthermore, the second movable rail 34 is moved upward, that is, toward the top plate 15 and fixed, such that the seal member 56 of the second movable rail 34 is pressed against the end portion 18*a* of the second casing 18 while the second abutting portion 34*a* of the second movable rail 34 is pressed against the end face 54*a* of the seal member 54 adhered to the fourth frame member 224. As a result, the second abutting portion 34*a* of the second movable rail 34 presses the fourth frame member 224 upward via the end face 54*a* of the seal member 54.

Consequently, the rotation force F in the one direction indicated by the circular arrow of FIG. 8 is imparted to the heat exchanger 20, such that the end face 51*a* of the seal member 51 adhered to the first frame member 221 is pressed against the first abutting portion 31*a* of the first fixed rail 31 while the end face 52*a* of the seal member 52 adhered to the second frame member 222 is pressed against the first abutting portion 32*a* of the second fixed rail 32. As a result, the corner portions 20*a* at the four corners of the heat exchanger 20, that is, all of the frame members 22 are pressed against the support members 30, and the heat exchanger 20 is supported by the support members 30 in the housing 10. The seal members 51, 52, 53, and 54 adhered to the corner portions 20*a* at the four corners of the heat exchanger 20, that is, the seal members 51 to 54 adhered to the frame members 22 are pressed against the support members 30, such that the seal members 51, 52, 53, 54, 55 and 56 are sufficiently compressed to suppress leakage of airflow between the supply air flow path and the exhaust air flow path. As a result, it is possible to suppress mixing of contaminant elements contained in the exhaust airflow, into the supply air flow, and reduction in heat exchange efficiency. Since airtightness can be reliably provided between the supply air flow path and the exhaust air flow path, the controllability of airflow rates in the supply air flow path and the exhaust air flow path can be improved. The static pressure at a connection between a duct (not illustrated) and the housing 10 is reduced, so that the capacity of a motor for blowing air to the heat exchange ventilator 1 can be reduced to suppress the power consumption.

As described above, the abutting surface 101 between the end face 51*a* of the seal member 51 adhered to the first frame member 221 and the first abutting portion 31*a* of the first fixed rail 31, and the abutting surface 102 between the end face 52*a* of the seal member 52 adhered to the second frame member 222 and the first abutting portion 32*a* of the second fixed rail 32 extend in parallel to the plane A. The abutting surface 103 between the end face 53*a* of the seal member 53 adhered to the third frame member 223 and the second abutting portion 33*a* of the first movable rail 33, and the abutting surface 104 between the end face 54*a* of the seal member 54 adhered to the fourth frame member 224 and the second abutting portion 34*a* of the second movable rail 34 extend in parallel to the plane B.

Thus, it is possible to prevent the compression of the seal members 51, 52, 53, and 54 from being lessened, even if the heat exchange element 21 contracts, due to long-term use, toward the axial center 21*o*, that is, contracts along directions parallel to the planes A and B, as illustrated in FIG. 7. In addition, it is possible to ensure the sufficient lengths of the abutting surfaces 101, 102, 103, and 104 even if the heat exchange element 21 contracts toward the axial center 21*o*, that is, contracts along the directions parallel to the planes A and B, and each frame member 22 of the heat exchanger 20 is moved toward the axial center 21*o* along with the contraction and deformation of the heat exchange element 21. As a result, it is possible to ensure a sealing property between the supply air flow path and the exhaust air flow path for a long period of time.

On the other hand, when the heat exchanger 20 is removed from the housing 10, as illustrated in FIG. 9, the first movable rail 33 is moved upward away from the end portion 17*a* of the first casing 17 and the end face 53*a* of the seal member 53 adhered to the third frame member 223 while the second movable rail 34 is moved downward away from the end portion 18*a* of the second casing 18 and the end face 54*a* of the seal member 54 adhered to the fourth frame member 224. As a result, the rotation force F in the one direction imparted from the first movable rail 33 and the second movable rail 34 to the heat exchanger 20 when the heat exchanger 20 is mounted is removed, thereby allowing rotation of the heat exchanger 20 in the other direction indicated by the circular arrow of FIG. 9.

When the heat exchanger 20 is manipulated via the maintenance opening 130 of the third side plate 13 of the housing 10 for rotation in the other direction indicated by the circular arrow of FIG. 9, the end face 51*a* of the seal member 51 adhered to the first frame member 221 can move away from the first fixed rail 31, and the end face 52*a* of the seal member 52 adhered to the second frame member 222 can move away from the second fixed rail 32. As a result, the heat exchanger 20 can be easily slid and removed from the housing 10. The seal members 51, 52, 53, and 54 can be satisfactorily protected because the seal members 51, 52, 53, and 54 can avoid contacts with the first fixed rail 31, the second fixed rail 32, the first movable rail 33, and the second movable rail 34 when the heat exchanger 20 is removed from the housing 10.

Figure 10:
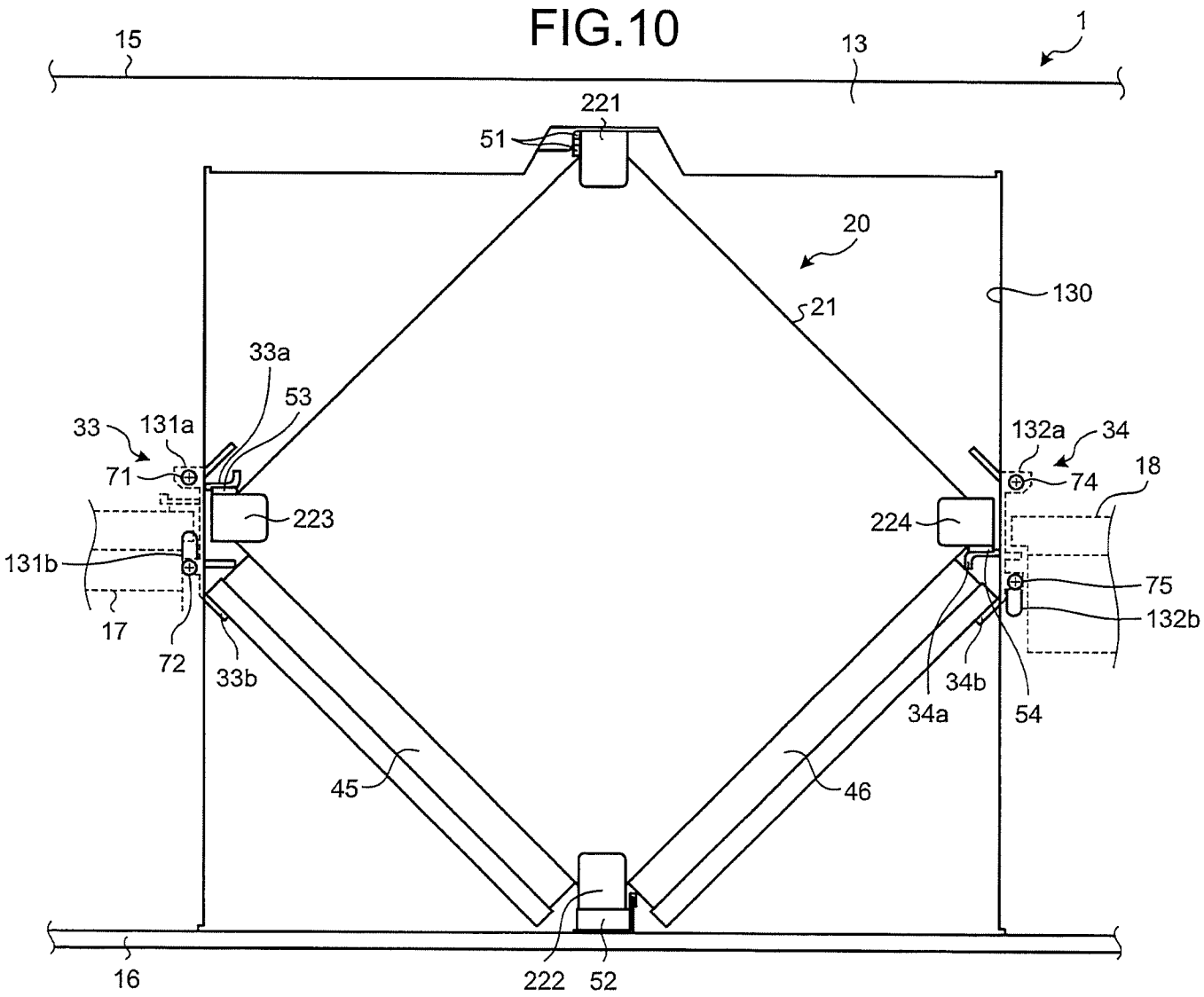
FIG. 10 is a front view illustrating the heat exchange ventilator when the heat exchanger is mounted.
Figure 11:
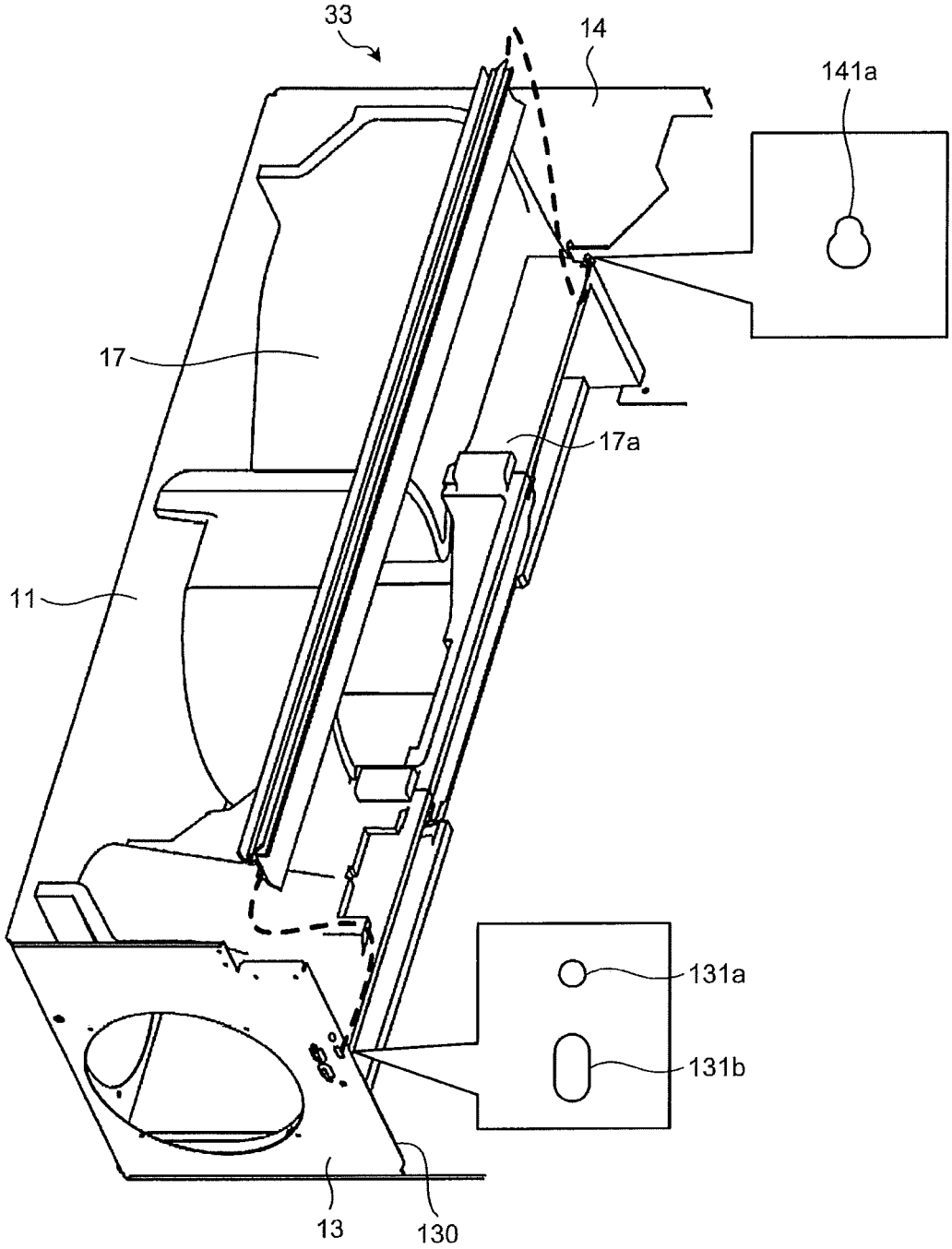
FIG. 11 is an exploded perspective view illustrating a location where a first movable rail is mounted to the housing.

Next, a structure for mounting the first movable rail 33 and the second movable rail 34 to the housing 10 will be described. FIG. 10 is a front view illustrating the heat exchange ventilator 1 when the heat exchanger 20 is mounted, and FIG. 11 is an exploded perspective view illustrating a location where the first movable rail 33 is mounted to the housing 10. FIG. 10 illustrates a state in which the maintenance cover 40 is removed from the third side plate 13.

As illustrated in FIGS. 10 and 11, the third side plate 13 of the housing 10 includes a first fastening hole 131*a* and a first long hole 131*b* provided for mounting the first movable rail 33. The first long hole 131*b* is formed under the first fastening hole 131*a*. That is, the first long hole 131*b* is formed on the side of the first fastening hole 131*a* closer to the bottom plate 16. The first long hole 131*b* extends in the direction perpendicular to the axial direction X of the heat exchange element 21 and in the vertical direction Y. As illustrated in FIG. 11, the fourth side plate 14 of the housing 10 includes a first coupling hole 141*a* provided for mounting the first movable rail 33. The first coupling hole 141*a* is a single hole including a small diameter portion and a large diameter portion connected to the small diameter portion. In the first coupling hole 141*a*, the small diameter portion is formed over the large diameter portion. That is, the small diameter portion is formed on the side of the large diameter portion closer to the top plate 15.

Figure 12:
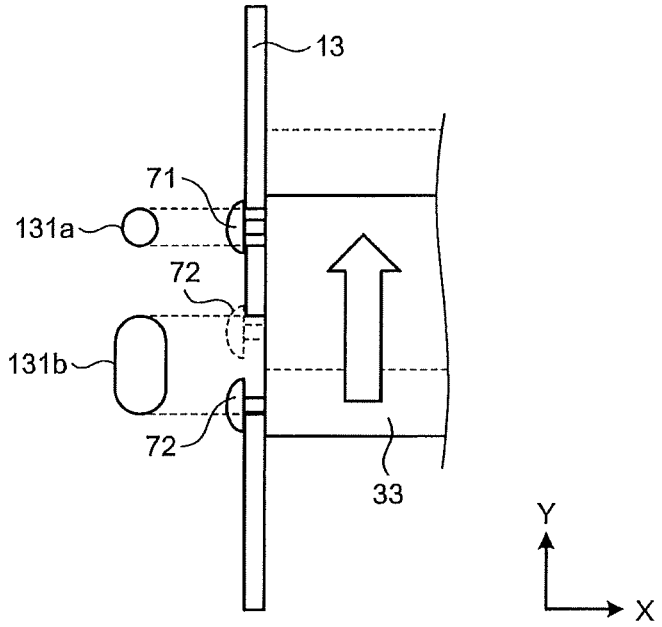
FIG. 12 is a cross-sectional view illustrating a mounting portion of the first movable rail on a third side plate.
Figure 13:
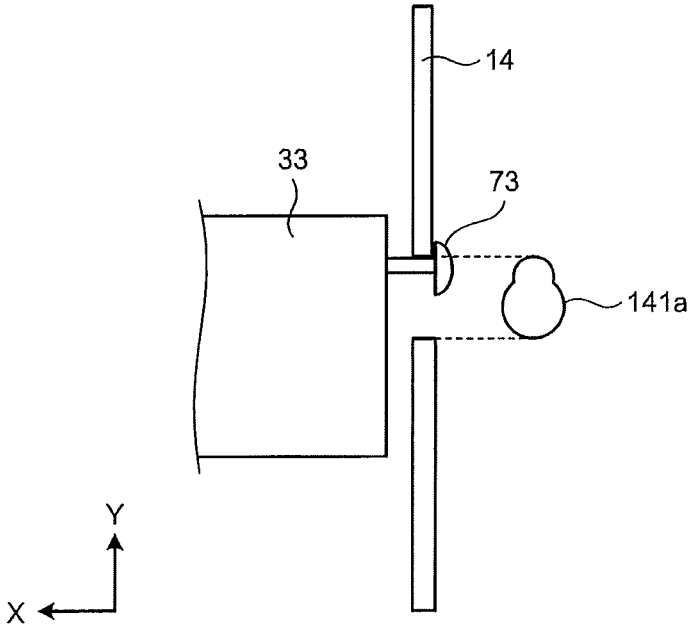
FIG. 13 is a cross-sectional view illustrating a mounting portion of the first movable rail on a fourth side plate.

FIG. 12 is a cross-sectional view illustrating a mounting portion of the first movable rail 33 on the third side plate 13, and FIG. 13 is a cross-sectional view illustrating a mounting portion of the first movable rail 33 on the fourth side plate 14. As illustrated in FIG. 12, an end portion of the first movable rail 33 on the side of the third side plate 13 includes screw holes having internal threads formed therein, and screws 71 and 72 are screwed into these screw holes. When the heat exchanger 20 is mounted as illustrated in FIG. 10, the first movable rail 33 is fastened and fixed to the third side plate 13 by the screw 71 inserted into the first fastening hole 131*a* of the third side plate 13 and the screw 72 inserted into a lower portion of the first long hole 131*b* of the third side plate 13.

As illustrated in FIG. 13, an end portion of the first movable rail 33 on the side of the fourth side plate 14 includes a screw hole having an internal thread therein, and a screw 73 is screwed through this screw hole of the end portion of the rail 33 and hooked on the small diameter portion of the first coupling hole 141*a*. The screw 73 is screwed into the screw hole in advance. A head of the screw 73 is sized to pass through the large diameter portion of the first coupling hole 141*a*. As described above, when the first movable rail 33 is fixed to the third side plate 13 and the fourth side plate 14, that is, when the heat exchanger 20 is mounted, the first movable rail 33 presses the third frame member 223 of the heat exchanger 20 from above, that is, from the side of the top plate 15. As a result, when the first movable rail 33 is fastened and fixed to the third side plate 13, the first movable rail 33 receives an upward force acting as a reaction force from the heat exchanger 20. As long as the head of the screw 73 is hooked on the small diameter portion of the first coupling hole 141*a*, thus, it is possible to fix the first movable rail 33 to the fourth side plate 14.

Figure 14:
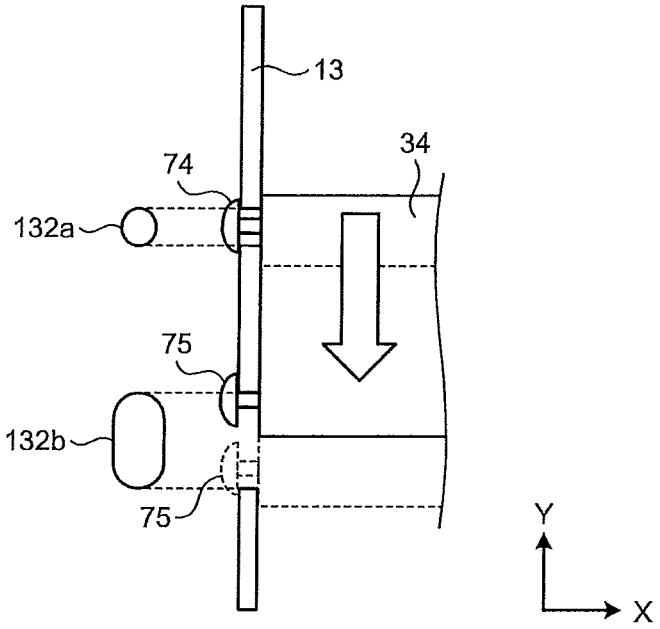
FIG. 14 is a cross-sectional view illustrating a mounting portion of a second movable rail on the third side plate.
Figure 15:
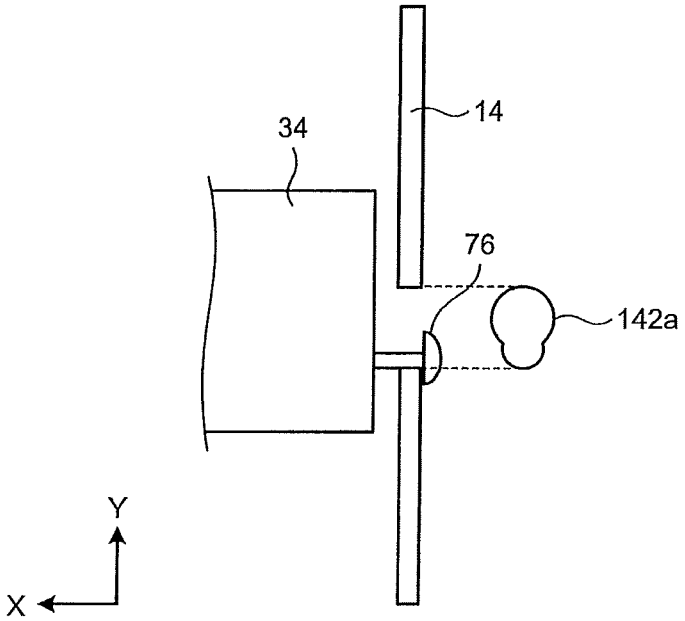
FIG. 15 is a cross-sectional view illustrating a mounting portion of the second movable rail on the fourth side plate.

FIG. 14 is a cross-sectional view illustrating a mounting portion of the second movable rail 34 on the third side plate 13, and FIG. 15 is a cross-sectional view illustrating a mounting portion of the second movable rail 34 on the fourth side plate 14. As illustrated in FIGS. 10 and 14, the third side plate 13 of the housing 10 includes a second fastening hole 132*a* and a second long hole 132*b* provided for mounting the second movable rail 34. The second long hole 132*b* is formed under the second fastening hole 132*a*. That is, the second long hole 132*b* is formed on the side of the second fastening hole 132*a* closer to the bottom plate 16. The second long hole 132*b* extends in the direction perpendicular to the axial direction X of the heat exchange element 21 and in the vertical direction Y. As illustrated in FIG. 15, the fourth side plate 14 of the housing 10 includes a second coupling hole 142*a* provided for mounting the second movable rail 34. The second coupling hole 142*a* is a single hole including a small diameter portion and a large diameter portion connected to the small diameter. In the second coupling hole 142*a*, the small diameter portion is formed under the large diameter portion. That is, the smaller diameter is formed on the side of the large diameter portion closer to the bottom plate 16.

As illustrated in FIG. 14, an end portion of the second movable rail 34 on the side of the third side plate 13 includes screw holes having internal threads formed therein, and screws 74 and 75 are screwed into these screw holes. When the heat exchanger 20 is mounted as illustrated in FIG. 10, the second movable rail 34 is fastened and fixed to the third side plate 13 by the screw 74 inserted into the second fastening hole 132*a* of the third side plate 13 and the screw 75 inserted into an upper portion of the second long hole 132*b* of the third side plate 13.

As illustrated in FIG. 15, an end portion of the second movable rail 34 on the side of the fourth side plate 14 includes a screw hole having an internal thread formed therein, and the screw 76 is screwed through this screw hole and hooked on the small diameter portion of the second coupling hole 142*a*. The screw 76 is screwed into the screw hole in advance. A head of the screw 76 is sized to pass through the large diameter portion of the second coupling hole 142*a*. As described above, when the second movable rail 34 is fixed to the third side plate 13 and the fourth side plate 14, that is, when the heat exchanger 20 is mounted, the second movable rail 34 presses the fourth frame member 224 of the heat exchanger 20 from below, that is, from the side of the bottom plate 16. As a result, when the second movable rail 34 is fastened and fixed to the third side plate 13, the second movable rail 34 receives a downward force acting as a reaction force from the heat exchanger 20. As long as the head of the screw 76 is hooked on the small diameter portion of the second coupling hole 142*a*, thus, it is possible to fix the second movable rail 34 to the fourth side plate 14.

When the first movable rail 33 fixed to the third side plate 13 and the fourth side plate 14 is moved in the direction perpendicular to the axial direction X of the heat exchange element 21 as described above, the screw 71 is removed from the first movable rail 33 and the screw 72 is loosened to move along the first long hole 131*b*, as indicated by broken lines of FIG. 12, allowing the first movable rail 33 to move upward. At that time, in the fourth side plate 14, the screw 73 remains hooked on the small diameter portion of the first coupling hole 141*a*. That is, while the end portion of the first movable rail 33 on the side of the fourth side plate 14 remains fixed to the housing 10, the end portion of the rail 33 on the side of the third side plate 13 moves upward along the direction perpendicular to the axial direction X of the heat exchange element 21. Thus, it is possible to remove downward pressure applied to the third frame member 223 of the heat exchanger 20 by the first movable rail 33.

When the second movable rail 34 fixed to the third side plate 13 and the fourth side plate 14 is moved in the direction perpendicular to the axial direction X of the heat exchange element 21, the screw 74 is removed from the second movable rail 34 and the screw 75 is loosened to move along the second long hole 132*b*, as indicated by broken lines of FIG. 14, allowing the second movable rail 34 to move downward. At that time, in the fourth side plate 14, the screw 76 remains hooked on the small diameter portion of the second coupling hole 142*a*. That is, while the end portion of the second movable rail 34 on the side of the fourth side plate 14 remains fixed to the housing 10, the end portion of the rail 34 on the side of the third side plate 13 moves downward along the direction perpendicular to the axial direction X of the heat exchange element 21. Thus, it is possible to remove upward pressure applied to the fourth frame member 224 of the heat exchanger 20 by the second movable rail 34.

As described above, each of the first movable rail 33 and the second movable rail 34 is fixed to the housing 10 at its one end, that is, at the end portion thereof on the side of the fourth side plate 14 while each of the first movable rail 33 and the second movable rail 34 is supported at the other end, that is, at the end portion thereof on the side of the third side plate 13 to move in the direction perpendicular to the axial direction X of the heat exchange element 21. Thus, only by removing the screws 71 and 74 and loosening the screws 72 and 75, it possible to provide the first movable rail 33 and the second movable rail 34 with a range of movement in the direction perpendicular to the axial direction X of the heat exchange element 21, without removing the first movable rail 33 and the second movable rail 34 from the housing 10.

On the side of the fourth side plate 14 located away from the third side plate 13 having the maintenance opening 130 formed therein, the first movable rail 33 is hooked on the small diameter portion of the first coupling hole 141*a* by the screw 73 while the second movable rail 34 is hooked on the small diameter portion of the second coupling hole 142*a* by the screw 76. Thus, only by moving each of the screws 73 and 76 between the small diameter portion and the large diameter portion of the corresponding one of the first coupling hole 141*a* and the second coupling hole 142*a*, it is possible to fix the first movable rail 33 and the second movable rail 34 to the fourth side plate 14 and to release the fixation. Thus, the first movable rail 33 and the second movable rail 34 can be easily attached to and detached from the housing 10.

Instead of the screw 73 being screwed into the end portion of the first movable rail 33 on the side of the fourth side plate 14 in advance, this end portion may have a projection capable of being inserted into the large diameter portion of the first coupling hole 141*a* and hooked on the small diameter portion thereof. Instead of the screw 76 being into the end portion of the second movable rail 34 on the side of the fourth side plate 14 in advance, this end portion may have a projection capable of being inserted into the large diameter portion of the second coupling hole 142*a* and hooked on the small diameter portion thereof.

As described above, in the heat exchanger 20 according to the first embodiment, the frame members 22 each mounted to the corresponding one of the sides 21*a* extending along the axial direction X of the heat exchange element 21 are movable along with the deformation of the heat exchange element 21. Thus, even if the heat exchange element 21 is deformed by the long-term use, it is possible to satisfactorily suppress the deformation of the frame members 22, the unsticking of the frame members 22 from the heat exchange element 21, and the deformation of or damage to the heat exchange element 21. Accordingly, even if the heat exchange element 21 of the heat exchanger 20 contracts due to the long-term use, it is possible to prevent the gap from being formed between the heat exchange element 21 and each frame member 22 and from being formed inside the heat exchange element 21 and thus suppress occurrence of leakage of airflow between the supply air flow and the exhaust air flow.

The heat exchanger 20 further includes the cover members 23 each covering the end face 21*b* perpendicular to the axial direction X of the heat exchange element 21, the frame members 22 being connected to the cover members 23. The gaps 25 and 26, which allow each frame member 22 to move along the direction perpendicular to the axial direction X of the heat exchange element 21 are provided in each of the coupling portions 24 at which the frame members 22 are connected to the cover members 23. Thus, it is possible to move the frame members 22 with respect to each cover member 23 along with the deformation of the heat exchange element 21, when the heat exchange element 21 contracts toward the axial center 21*o*.

The gaps 25 and 26 have the same length for each of the connecting portions 24 at which the frame members 22 are connected to the cover members 23. This makes it possible to suppress the uneven amounts of movements of the frame members 22 positioned on the diagonal line, thus satisfactorily suppressing the displacement of the axial center 21*o* of the heat exchange element 21 from the position in which the heat exchanger 20 is initially mounted. On the basis of a contraction deformation amount of the heat exchange element 21, the gaps 25 and 26 may have different lengths for each of the connecting portions 24 at which the frame members 22 are connected to the cover members 23. Although, in the first embodiment, the length of the gaps 25 and 26 is set to be half the maximum contraction length of the heat exchange element 21, the length of the gaps 25 and 26 may be set to be the maximum contraction length of the heat exchange element 21.

The connecting portion 24 includes the protrusion 22*b* and the recess 23*b*. The protrusion 22*b* extends from the one end of the frame member 22 in the direction perpendicular to the axial direction X of the heat exchange element 21. The recess 23*b* is formed in the corner portion 231 of the opposite surface of the cover member 23 to the end face 21*b* of the heat exchange element 21, and is recessed toward the end face 21*b*. The protrusion 22*b* fits in the recess 23*b* such that the protrusion 22*b* is slidable in the direction perpendicular to the axial direction X of the heat exchange element 21. The gap 25 is provided between the protrusion distal end 22*c* of the protrusion 22*b* and the recess proximal end 23*d* of the recess 23*b*. The gap 26 is provided between the recess distal end 23*c* of the recess 23*b* and the protrusion proximal end 22*d* of the protrusion 22*b*. Thus, it is possible to slide the protrusions 22*b* of each frame member 22 and the recesses 23*b* of each cover member 23 in the direction perpendicular to the axial direction X of the heat exchange element 21 along with the deformation of the heat exchange element 21, when the heat exchange element 21 contracts toward the axial center 21*o*. As a result, it is possible to move the frame members 22 with respect to the cover members 23 along with the deformation of the heat exchange element 21.

The protrusion 22*b* includes the frame-side hooking portions 22*t*, and the recess 23*b* includes the cover-side hooking portions 23*t*, which can be hooked on the frame-side hooking portions 22*t*. Thus, it is possible to prevent the protrusions 22*b* and the recesses 23*b* from coming off easily, and therefore, suppress the disengagement of each frame member 22 from the cover members 23 in mounting the one end of each frame member 22 and subsequently mounting the other end thereof during the assemblage.

The frame-side hooking portions 22*t* and the cover-side hooking portions 23*t* are formed to be connectable to each other by snap fitting. Thus, it is it possible to easily connect the frame-side hooking portions 22*t* and the cover-side hooking portions 23*t* to each other.

The configuration of the connecting portion 24 is not limited to that described in the first embodiment as long as the configuration allows the movement of the frame members 22 in the direction perpendicular to the axial direction X of the heat exchange element 21. For example, the protrusions 22*b* of the frame members 22 may have depressions provided on both side portions thereof extending in the direction perpendicular to the axial direction X of the protrusions 22*b* of the frame members 22 while the recesses 23*b* of the cover members 23 may have projections formed on both side portions thereof, the projections being capable of being hooked on the depressions of the protrusions 22*b*. In that case, if the depressions of the protrusions 22*b* are formed to extend in the direction perpendicular to the axial direction X and the projections of the recesses 23*b* are hooked on the lower edges of the depressions, the frame members 22 is allowed to move in the direction perpendicular to the axial direction X. The recess proximal end 23*d* of each recess 23*b* of the cover members 23 may have a cover-side hooking portion formed thereat, the cover-side hooking portion extending toward the recess distal end 23*c* and having a hook shape while the protrusion distal end 22*c* of each protrusion 22*b* of the frame members 22 may have a frame-side hooking portion capable of hooking the cover-side hooking portion. A recess may be formed on a surface of each protrusion 22*b* of the frame members 22 on the side of the frame body 22*a*, and a protrusion slidably fitting in the recess may be formed at each corner portion 231 of the cover members 23.

Each frame member 22 may be disposed in such a position as to form a gap between the frame-side hooking portions 22*t* and the cover-side hooking portions 23*t* without hooking the frame-side hooking portions 22*t* of the frame members 22 and the cover-side hooking portions 23*t* of the cover members 23 on each other. In this case, each frame member 22 can move in a direction away from the axial center 21*o* of the heat exchange element 21 along with the expansion of the heat exchange element 21 if such an expansion occurs due to the element 21 absorbing water.

The abutting surfaces between the support members 30 and the frame members 22, that is, the abutting surface 101 between the end face 51*a* of the seal member 51 adhered to the first frame member 221 and the first abutting portion 31*a* of the first fixed rail 31, and the abutting surface 102 between the end face 52*a* of the seal member 52 adhered to the second frame member 222 and the first abutting portion 32*a* of the second fixed rail 32 extend in parallel to the plane A. The abutting surface 103 between the end face 53*a* of the seal member 53 adhered to the third frame member 223 and the second abutting portion 33*a* of the first movable rail 33, and the abutting surface 104 between the end face 54*a* of the seal member 54 adhered to the fourth frame member 224 and the second abutting portion 34*a* of the second movable rail 34 extend in parallel to the plane B.

Thus, it is possible to ensure the sufficient lengths of the abutting surfaces 101, 102, 103, and 104 even if the heat exchange element 21 contracts toward the axial center 21*o* due to long-term use, that is, contracts along the direction parallel to the planes A and B and each frame member 22 of the heat exchanger 20 is moved toward the axial center 21*o* along with the contraction and deformation of the heat exchange element 21. As a result, it is possible to ensure a sealing property between the supply air flow path and the exhaust air flow path for a long period of time.

In a case where there is no possibility of airflow leaking from between each frame member 22 and each support member 30, the seal members 51, 52, 53 and 54 may be omitted and the frame member may abut directly on the corresponding abutting portion. That is, the first frame member 221 may abut directly on the first abutting portion 31*a* of the first fixed rail 31. The second frame member 222 may abut directly on the first abutting portion 32*a* of the second fixed rail 32. The third frame member 223 may abut directly on the second abutting portion 33*a* of the first movable rail 33. The fourth frame member 224 may abut directly on the second abutting portion 34*a* of the second movable rail 34. There is no possibility of the leakage of airflow from between each frame member 22 and each support member 30, for example, where the pressure of the airflow around the abutting portion between each frame member 22 and each support member 30 is low, or where the surface accuracy of the abutting surface between each frame member 22 and each support member 30 can be increased to ensure adhesiveness, that is, airtightness of the abutting surface.

Second Embodiment

Figure 16:
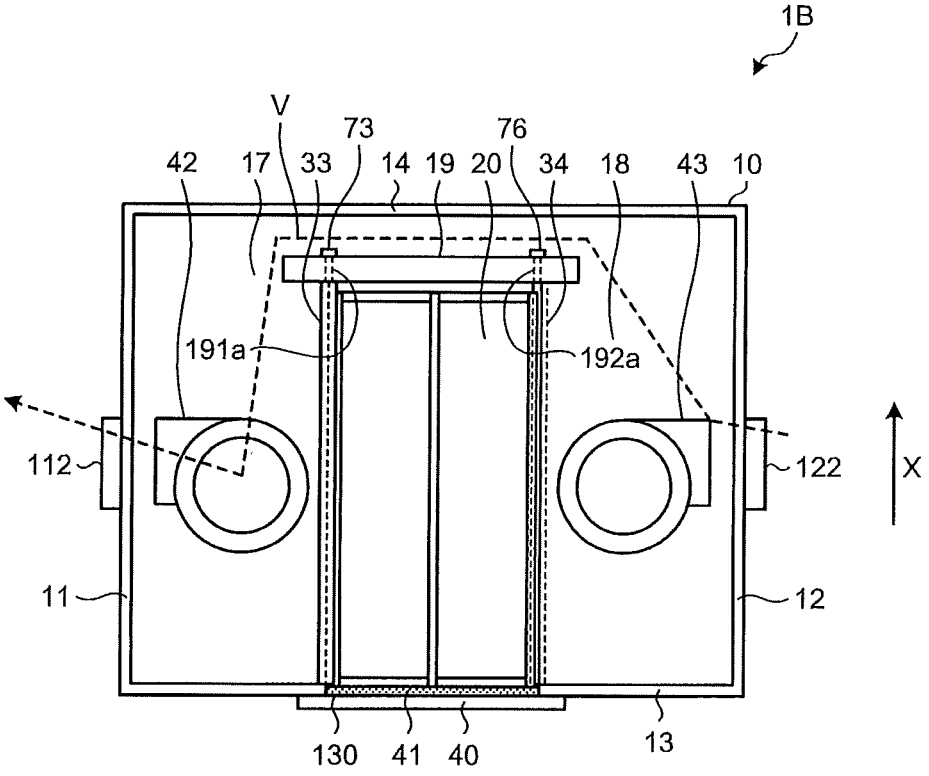
FIG. 16 is a schematic plan view illustrating a heat exchange ventilator according to a second embodiment.

FIG. 16 is a schematic plan view illustrating a heat exchange ventilator 1B according to a second embodiment. In addition to the configuration of the heat exchange ventilator 1 according to the first embodiment, the heat exchange ventilator 1B includes a separating plate 19 for forming a bypass flow path V to guide the exhaust air flow in the exhaust flow path from the upstream side of the heat exchanger 20 to the downstream side of the heat exchanger 20, as illustrated in the figure. The separating plate 19 is provided closer to the fourth side plate 14 than the heat exchanger 20 is, and is fixed to the housing 10. In the heat exchange ventilator 1B, the end face of the heat exchanger 20 on the side of the fourth side plate 14 abuts on the separating version 19 when the heat exchanger 20 is mounted to the housing 10. The separating plate 19 may form a bypass flow path to guide the supply air flow in the supply air flow path from the upstream side of the heat exchanger 20 to the downstream side of the heat exchanger 20.

The separating plate 19 includes a first coupling hole 191*a* and a second coupling hole 192*a* formed therein. The first coupling hole 191*a* has the same shape as the first coupling hole 141*a* formed in the fourth side plate 14 of the heat exchange ventilator 1 according to the first embodiment. The second coupling hole 192*a* has the same shape as the second coupling hole 142*a* formed in the fourth side plate 14 of the heat exchange ventilator 1 according to the first embodiment. On the side of one end of the first movable rail 33, that is, at the end portion of the rail 33 on the side of the fourth side plate 14 of the heat exchange ventilator 1B, the screw 73 is hooked on a small diameter portion of the first coupling hole 191*a* of the separating plate 19, which is a component fixed to the housing 10. On the side of one end of the second movable rail 34, that is, at the end portion of the rail 34 on the side of the fourth side plate 14, the screw 76 is hooked on a small diameter portion of the second coupling hole 192*a* of the separating plate 19, which is a component fixed to the housing 10. The structure of the mounting portion at the other end, that is, the end portion of each of the first movable rail 33 and the second movable rail 34 on the side of the third side plate 13 is similar to that of the heat exchange ventilator 1 according to the first embodiment.

As described above, in the heat exchange ventilator 1B according to the second embodiment, each of the first movable rail 33 and the second movable rail 34 is fixed at one end thereof to the component fixed to the housing 10, that is, the separating plate 19, and is supported at the other end thereof by the third side plate 13 of the housing 10 to move in a direction perpendicular to the axial direction X of the heat exchange element 21. Thus, it is possible to provide the first movable rail 33 and the second movable rail 34 with a range of movement in the direction perpendicular to the axial direction X of the heat exchange element 21, without removing the first movable rail 33 and the second movable rail 34 from the housing 10 and the separating plate 19. As long as the first movable rail 33 and the second movable rail 34 are operable via the maintenance opening 130, each of the first and second movable rails may be supported at the end portion thereof on the side of the third side plate 13 of the housing 10 by a member fixed to the housing 10 different from the third side plate 13, such that each movable rail can move in the direction perpendicular to the axial direction X of the heat exchange element 21. In addition, each of the first movable rail 33 and the second movable rail 34 may be supported at the end portion thereof mounted to the separating plate 19 to move in the direction perpendicular to the axial direction X of the heat exchange element 21, as with the end portion on the side of the third side plate 13.

In the first and second embodiments, the present invention is applied to the heat exchange ventilators 1 and 1B, which are total heat exchange-type ventilators, but the present invention may be applied to a sensible heat exchange-type ventilator. In the first and second embodiments, a single heat exchanger 20 is used, but a plurality of heat exchangers 20 may be inserted in series into the housing 10. In that case, a seal member is disposed between the heat exchangers 20 to ensure airtightness between the heat exchangers 20.

The configuration described in the embodiments above indicates one example of the content of the present invention and can be combined with other known technology, and a part thereof can be omitted or modified without departing from the gist of the present invention.

REFERENCE SIGNS LIST

1 heat exchange ventilator; 10 housing; 11 first side plate; 111 outdoor-side inlet; 112 outdoor-side exhaust port; 12 second side plate; 121 indoor-side inlet; 122 indoor-side outlet; 13 third side plate; 130 maintenance opening; 131*a* first fastening hole; 131*b* first long hole; 132*a* second fastening hole; 132*b* second long hole; 14 fourth side plate; 141*a* first coupling hole; 142*a* second coupling hole; 15 top plate; 16 bottom plate; 17 first casing; 17*a* end portion; 18 second casing; 18*a* end portion; 19 separating plate; 191*a* first coupling hole; 192*a* second coupling hole; 20 heat exchanger; 20*a* corner portion; 21 heat exchange element; 21*a* side; 21*b* end face; 21*o* axial center; 22 frame member; 22*a* frame body; 22*b* protrusion; 22*c* protrusion distal end; 22*d* protrusion proximal end; 22*t* frame-side hooking portion; 221 first frame member; 222 second frame member; 223 third frame member; 224 fourth frame member; cover member; 23*a* cover body; 23*b* recess; 23*c* recess distal end; 23*d* recess proximal end; 23*t* cover-side hooking portion; 231 corner portion; 24 connecting portion; 25, 26 gap; 30 support member; 31 first fixed rail; 31*a*, 32*a* first abutting portion; 32 second fixed rail; 33 first movable rail; 33*a*, 34*a* second abutting portion; 33*b*, 34*b*, filter support; 34 second movable rail; 40 maintenance cover; 41 seal member; 42 exhaust air blower; 43 supply air blower; 44 handle; 45, 46 filter; 51, 52, 53, 54, 55, 56 seal member; 51*a*, 52*a*, 53*a*, 54*a* end face; 60 rotation force imparting means; 71, 72, 73, 74, 75, 76 screw; 101, 102, 103, 104 abutting surface.

The invention claimed is:

1. A heat exchanger to perform heat exchange between a supply air flow and an exhaust air flow, comprising:

a prism-shaped heat exchange element;

a plurality of frame members mounted to sides of the heat exchange element in a one-to-one relationship, the sides extending along an axial direction of the heat exchange element; and cover members each including an end face of the heat exchange element, the end face being perpendicular to the axial direction of the heat exchange element, the frame members being connected to each of the cover members, wherein two spaced apart gaps configured to allow movement of each of the frame members along with deformation of the heat exchange element in a direction perpendicular to the axial direction of the heat exchange element are provided at a connecting portion at which each frame member is connected to a respective cover member, and wherein the connecting portion includes a protrusion extending from one end of each of the frame members in a direction perpendicular to the axial direction, and a recess formed in a corner portion of a surface of the cover member, the surface being opposite to the end face of the heat exchange element, the recess being recessed toward the end face, the protrusion fits in the recess to slide in a direction perpendicular to the axial direction, and the gaps are provided between a distal end of the protrusion and a proximal end of the recess, and between a distal end of the recess and a proximal end of the protrusion.

2. The heat exchanger according to claim 1, wherein the gaps have the same length for each connecting portion at which the frame members are connected to the cover member.

3. The heat exchanger according to claim 1, wherein the protrusion includes frame-side hooking portions, and the recess includes cover-side hooking portions capable of being hooked on the frame-side hooking portions.

4. The heat exchanger according to claim 3, wherein the frame-side hooking portions are connectable to the cover-side hooking portions by snap fitting.

5. A heat exchange ventilator comprising the heat exchanger according to claim 1, the heat exchange ventilator comprising:

a housing accommodating the heat exchanger to allow the heat exchanger to be inserted into and removed from the housing; and a plurality of support members abutting on the frame members of the heat exchanger in the housing to support the heat exchanger, wherein abutting surfaces between the support members and the frame members each extend in parallel to planes passing through the side of the heat exchange element and an axial center of the heat exchange element.

6. A heat exchange ventilator comprising the heat exchanger according to claim 2, the heat exchange ventilator comprising:

a housing accommodating the heat exchanger to allow the heat exchanger to be inserted into and removed from the housing; and a plurality of support members abutting on the frame members of the heat exchanger in the housing to support the heat exchanger, wherein abutting surfaces between the support members and the frame members each extend in parallel to planes passing through the side of the heat exchange element and an axial center of the heat exchange element.

7. A heat exchange ventilator comprising the heat exchanger according to claim 3, the heat exchange ventilator comprising:

a housing accommodating the heat exchanger to allow the heat exchanger to be inserted into and removed from the housing; and a plurality of support members abutting on the frame members of the heat exchanger in the housing to support the heat exchanger, wherein abutting surfaces between the support members and the frame members each extend in parallel to planes passing through the side of the heat exchange element and an axial center of the heat exchange element.

8. A heat exchange ventilator comprising the heat exchanger according to claim 4, the heat exchange ventilator comprising:

a housing accommodating the heat exchanger to allow the heat exchanger to be inserted into and removed from the housing; and a plurality of support members abutting on the frame members of the heat exchanger in the housing to support the heat exchanger, wherein abutting surfaces between the support members and the frame members each extend in parallel to planes passing through the side of the heat exchange element and an axial center of the heat exchange element.

* * * * *